US007694690B2

(12) United States Patent
Yen

(10) Patent No.: US 7,694,690 B2
(45) Date of Patent: Apr. 13, 2010

(54) WASHING MECHANISM FOR OPTICAL MEMBERS

(75) Inventor: Shih-Chieh Yen, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 966 days.

(21) Appl. No.: 11/450,427

(22) Filed: Jun. 9, 2006

(65) Prior Publication Data

US 2007/0056614 A1 Mar. 15, 2007

(30) Foreign Application Priority Data

Sep. 9, 2005 (TW) ..... 94131036 A

(51) Int. Cl.
*B08B 3/04* (2006.01)

(52) U.S. Cl. ..... 134/134; 211/41.18

(58) Field of Classification Search ..... 134/135; 211/41.1–41.18

See application file for complete search history.

(56) References Cited

U.S. PATENT DOCUMENTS 2,426,995 A * 9/1947 Gibbs ..... 312/71
2,802,575 A * 8/1957 Harrison ..... 108/106
3,331,337 A * 7/1967 Mackay ..... 108/136
3,428,185 A * 2/1969 Vorndran ..... 211/59.3
3,511,548 A * 5/1970 Mcilhone ..... 312/71
3,682,083 A * 8/1972 Puente ..... 396/654
4,190,683 A * 2/1980 Davies et al. ..... 427/130
5,584,401 A * 12/1996 Yoshida ..... 211/41.1
5,984,115 A * 11/1999 Koestenblatt et al. ..... 211/40
6,056,123 A * 5/2000 Niemirowski et al. ..... 206/711
6,276,592 B1 * 8/2001 Jochmann et al. ..... 228/121
6,523,701 B1 * 2/2003 Yoshida et al. ..... 211/41.18
6,948,623 B2 * 9/2005 Takano ..... 211/41.1
7,201,280 B2 * 4/2007 Cho ..... 211/41.18

FOREIGN PATENT DOCUMENTS

CN 99234336.4 4/2000
DE 41 36 342 * 5/1993

* cited by examiner

*Primary Examiner*—Frankie L Stinson
(74) *Attorney, Agent, or Firm*—Steven M. Reiss

(57) ABSTRACT

An exemplary washing mechanism (9) for optical members includes a positioning assembly (10), a carrying assembly (20), and an adjusting assembly (30). The carrying assembly is mounted on the positioning assembly and includes poles (22) and slidable members. The slidable members are configured for holding optical members. Each slidable member is slidably mounted on a corresponding pole. The adjusting assembly is mounted on the positioning assembly and the carrying assembly and configured for adjusting a position of the carrying assembly.

16 Claims, 2 Drawing Sheets

WASHING MECHANISM FOR OPTICAL MEMBERS

TECHNICAL FIELD

The present invention generally relates to washing mechanisms and, more particularly, to a washing mechanism for optical members such as optical lenses, optical filters, or such like.

BACKGROUND

With the ongoing development of microcircuitry and multimedia technologies, digital cameras have become a highly popular way of taking pictures. High-end portable electronic devices, such as mobile phones and personal digital assistants (PDAs), are being developed to include increasing numbers of special features. Many of these portable electronic devices are now equipped with a digital camera module, these electronic devices enable consumers to enjoy capturing digital pictures anytime and anywhere, the smallest and most eye-catching cameras being the most popular.

In camera modules, optical lenses are very important to the quality of the pictures captured by the camera modules. In the process of manufacturing, the optical lenses need to be washed before plating a film thereon. A typical washing mechanism for optical members includes a housing full of water, an ultrasound producer, and a washing box retaining some water therein. The ultrasound producer is mounted at the bottom of the housing. The washing box is mounted in a top portion of the housing and touches the water. In use, one optical member is disposed in the washing box and the optical member immerges in the water. The ultrasound producer produces ultrasonic wave to enable the water in the washing box to wash the optical member. However, the washing mechanism only washes one optical member one time.

Therefore, a new washing mechanism is desired in order to overcome the above-described shortcomings.

SUMMARY

In one embodiment thereof, an washing mechanism for optical members includes a positioning assembly, a carrying assembly, and an adjusting assembly. The carrying assembly is mounted on the positioning assembly and includes a plurality of poles and a plurality of slidable members. The slidable members are configured for holding optical members. Each slidable member is slidably mounted on a corresponding pole. The adjusting assembly is mounted on the positioning assembly and the carrying assembly and configured for adjusting a position of the carrying assembly.

Other advantages and novel features of the embodiments will become more apparent from the following detailed description thereof when taken in conjunction with the accompanying drawings.

BRIEF DESCRIPTION OF THE DRAWINGS

Many aspects of the present washing mechanism can be better understood with reference to the following drawings. The components in the drawings are not necessarily drawn to scale, the emphasis instead being placed upon clearly illustrating the principles of the washing mechanism and its potential applications. Moreover, in the drawings, like reference numerals designate corresponding parts throughout the several views.

DETAILED DESCRIPTION OF THE EMBODIMENTS

Figure 1:
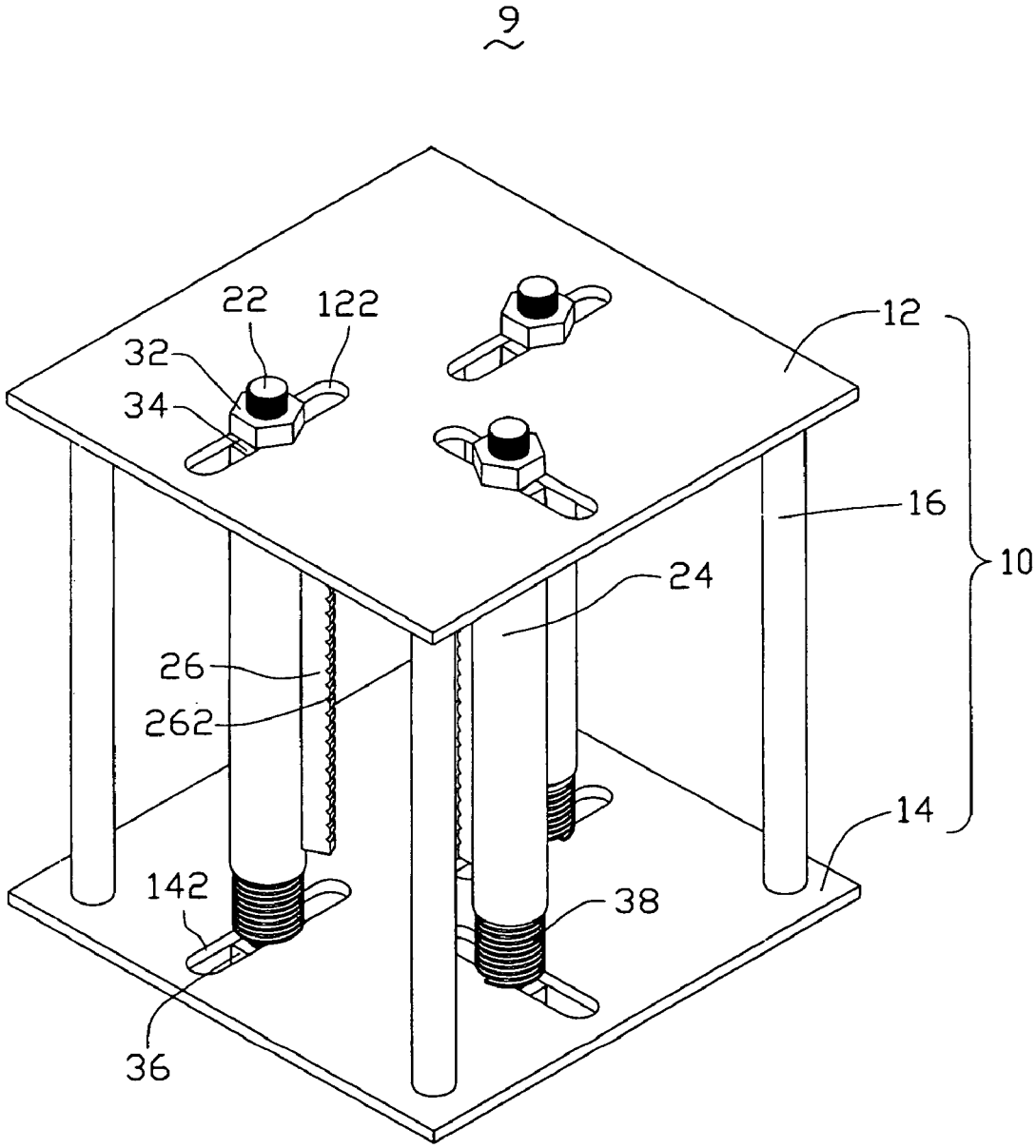
FIG. 1 is an assembled, isometric view of a washing mechanism in accordance with a preferred embodiment.
Figure 2:
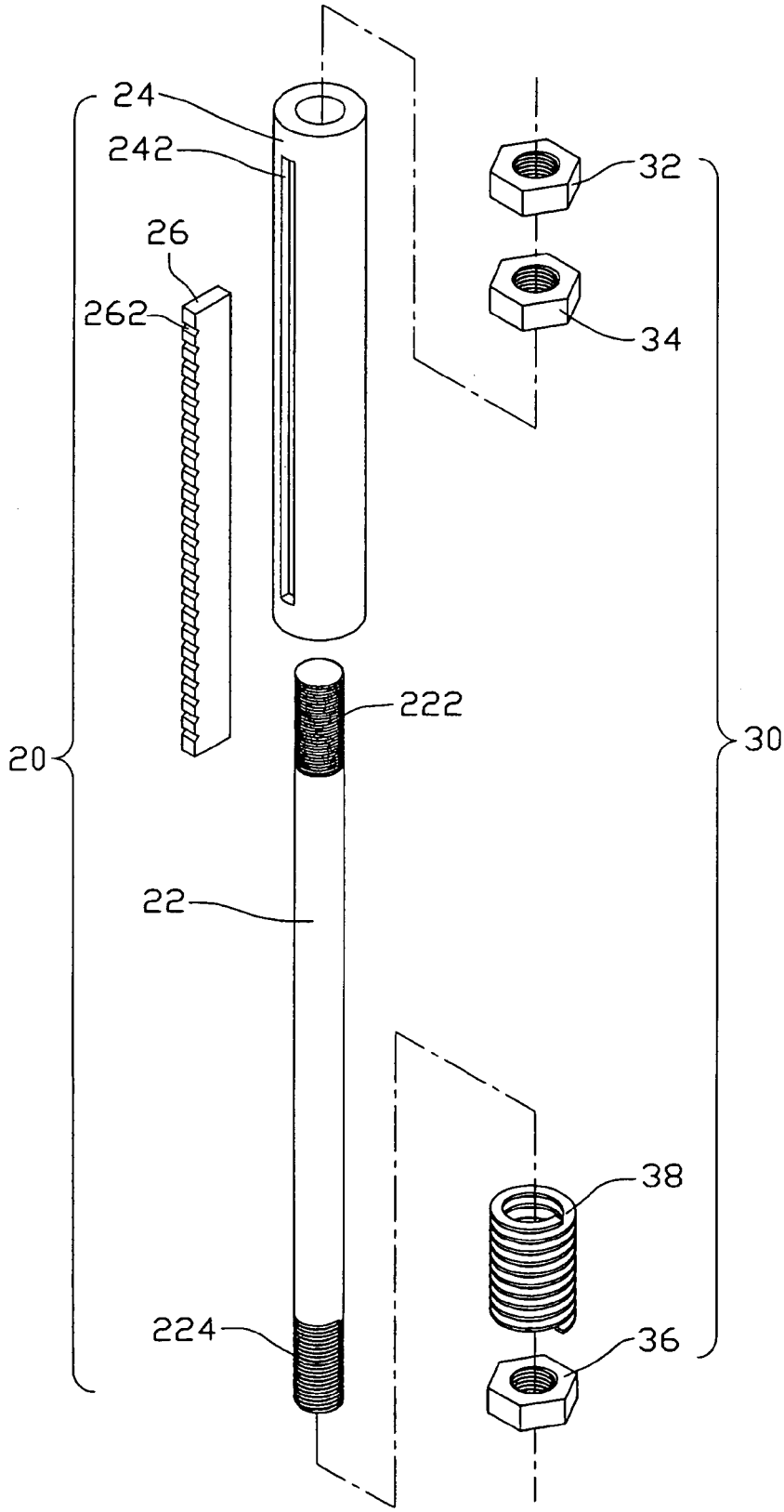
FIG. 2 is an enlarged, isometric view of a carrying assembly and an adjusting assembly of the washing mechanism shown in FIG. 1.

Referring now to the drawings in detail, FIGS. 1-2 show an washing mechanism 9 of a preferred embodiment of the present invention. The washing mechanism 9 is capable of washing a plurality of optical members one time. The optical members may be optical lenses, optical filters, or such like. The washing mechanism 9 includes a positioning assembly 10, a carrying assembly 20, and an adjusting assembly 30. The adjusting assembly 30 is configured to mount the carrying assembly 20 with the positioning assembly 10 and to adjust a position of the carrying assembly 20 relative to the positioning assembly 10.

The positioning assembly 10 includes a top board 12, a bottom board 14, and a plurality of supporting pillars 16. In this preferred embodiment, there are four supporting pillars 16. Both the top board 12 and the bottom board 14 are rectangular boards in shape. The top board 12 defines a plurality of top holes 122 therethrough. In this preferred embodiment, there are three top holes 122. The three top holes 122 are positioned in a substantially T-shaped formation. The bottom board 14 defines a plurality of bottom holes 142 therethrough. In this preferred embodiment, there are three bottom holes 142. The three bottom holes 142 are positioned in a substantially T-shaped formation. Each top hole 122 is positioned above a corresponding one of the bottom holes 142. Each supporting pillar 16 is mounted on the top board 12 and the bottom board 14, and between a corner of the top board 12 and a corresponding corner of the bottom board 14. The top board 12, the bottom board 14, and the supporting pillars 16 cooperate to form a space for receiving the carrying assembly 20.

Further referring to FIG. 2, the carrying assembly 20 is mounted between the top board 12 and the bottom board 14 for carrying a plurality of optical members therein. The carrying assembly 20 includes a plurality of poles 22 and a plurality of slidable members. Each slidable member is slidably mounted on its respective pole 22. The slidable member includes a sleeve 24 and a carrying part 26. In this preferred embodiment, there are three poles 22, three sleeves 24, and three carrying parts 26. One end of each pole 22 is formed with a screw thread 222. The other opposite end of each pole 22 is formed with a screw thread 224. A length of the pole 22 is larger than that of the pillar 16 of the positioning assembly 10 so that when each pole 22 is mounted in one top hole 122 of the top board 12 and in one corresponding bottom hole 142 of the bottom board 14, the two ends of the pole 22 are exposed out of the top hole 122 and the bottom hole 142 at the same time. The top holes 122 and the bottom holes 142 are configured to enable the poles 22 to move in a transverse direction and/or in a lengthways direction.

Each sleeve 24 is substantially a hollow cylinder in shape and defines a slot 242 therein. An inner diameter of the sleeve 24 is slightly larger than a diameter of the pole 22, so that the pole 22 may be slidably received in the sleeve 24. The length of the sleeve 24 is shorter than that of the pole 22, so that when the pole 22 is received in the sleeve 24, the end with the screw thread 222 and the end with the screw thread 224 are exposed out of the sleeve 24 simultaneously.

The carrying part 26 is substantially a rectangular board in shape and may be made of resin. The carrying part 26 defines a plurality of V-shaped grooves 262 at a first side. The slot 242 of the sleeve 24 is configured for receiving a second side of the carrying part 26 therein. The second side of the carrying part 26 is opposite to the first side of the carrying part 26.

The adjusting assembly 30 includes a plurality of nuts 32, 34 and 36 and a plurality of resilient members 38. In this preferred embodiment, there are nine nuts 32, 34 and 36 and three resilient members 38. Each resilient member 38 may be made of metal and may be spiral-shaped (i.e. like a coil spring). The nuts 32, 34 and 36 are configured for engaging with the screw threads 222, 224 of the pole 22 to connect the poles 22 with the boards 12, 14. An inner diameter of the resilient member 38 is slightly larger than the diameter of the pole 22, so that the resilient members 38 may slidably surround the pole 22.

In assembly, one end with the screw thread 224 of each pole 22 is inserted through one top hole 122, one corresponding nut 34, one corresponding sleeve 24, one corresponding resilient member 38, and one corresponding bottom hole 142 in that order. Two opposite ends of the pole 22 are exposed out of the top hole 122 and the bottom hole 142. One nut 32 is mounted to one end with the screw thread 222 of the pole 22, and one nut 36 is mounted to one end with the screw thread 224 of the pole 22, thereby mounting the carrying assembly 20 with the positioning assembly 10. Each resilient member 38 is mounted between the sleeve 24 and the bottom board 14. The first sides of the three carrying parts 26 face each other. The three grooves 262 of the three carrying parts 26 in one horizontal direction cooperate with each other in a manner so as to hold one optical member therein. Thus the washing mechanism 9 is assembled completely, as shown in FIG. 1.

In use, the nuts 32, 36 are released so that the carrying assembly 20 can slide up and down between the top board 12 and the bottom board 14 and can slide along the extending direction of the top hole 122 and simultaneously slide along the extension direction of the bottom hole 142. The nuts 32, 36 can be tightened so to fit the dimensions of the optical members that the carrying assembly 20 is fixed between the top board 12 and the bottom board 14. The nut 34 is screwed and the resilient member 38 is compressed or decompressed. At the same time the sleeve 24 slides up or down relative to the other sleeves 24 until the carrying parts 26 are located level with each other. The edge of the optical member is inserted into three grooves 262 positioned in an identical horizontal direction. The optical member is stably held in the carrying assembly 20 by the three carrying parts 26 supporting three points of the optical member. As such a plurality of optical members may be mounted in the washing mechanism 9 ready for washing. After washing, the washed optical members can be taken out from the carrying assembly 20. It is to be understood that, in manufacturing, the carrying assembly 20 may be adjusted according to the dimension of various optical members.

It is to be understood that the top board 12 and the bottom board 14 may alternatively have a different configuration such as a circular or polygonal board. The number of the slidable members is not necessarily limited to three. It may be two or more. The resilient members 38 may alternatively be made of another material (e.g. plastic or rubber). The resilient members 38 may alternatively have a different configuration, for example, a leaf spring or a resilient cylinder. The carrying part 26 may be integrally formed as part of the sleeve 24.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A washing mechanism for optical members, comprising:
- a positioning assembly;
- a carrying assembly being mounted on the positioning assembly, comprising:
  - a plurality of poles mounted on the positioning assembly; and
  - a plurality of slidable members configured for holding optical members, each slidable member being slidably mounted on a corresponding pole and including a carrying part and a sleeve, the sleeve defining a slot therein configured for receiving the carrying part, and the carrying part defining a plurality of grooves; and
- an adjusting assembly mounted on the positioning assembly and the carrying assembly and configured for adjusting a position of the carrying assembly.

2. The washing mechanism as claimed in claim 1, wherein the carrying part is a substantially rectangular board defining a plurality of V-shaped grooves.

3. The washing mechanism as claimed in claim 2, wherein the carrying part is made of resin.

4. The washing mechanism as claimed in claim 1, wherein the adjusting assembly includes a plurality of nuts, each end of the pole forming a screw thread, and one end of each pole being mounted on the positioning assembly by the nut engaging with the screw thread.

5. The washing mechanism as claimed in claim 1, wherein the adjusting assembly includes a plurality of nuts and a resilient member, each end of the pole forming a screw thread, and one end of each pole being mounted on the positioning assembly by the nut engaging with the screw thread and the resilient member being positioned between the slidable member and the positioning assembly.

6. The washing mechanism as claimed in claim 5, wherein the resilient member is a compression spring.

7. The washing mechanism as claimed in claim 1, wherein the positioning assembly includes a top board and a bottom board, and the carrying assembly is mounted between the top board and the bottom board.

8. The washing mechanism as claimed in claim 7, wherein the positioning assembly further includes a plurality of supporting pillars mounted between the top board and the bottom board.

9. The washing mechanism as claimed in claim 7, wherein the top board defines three top holes, and the three top holes are positioned in a T shape.

10. The washing mechanism as claimed in claim 9, wherein the bottom board defines three bottom holes, the three bottom holes are positioned in a T shape, and each bottom hole corresponds to one of the top holes.

11. A washing apparatus for optical members, comprising:
- a positioning member defining a plurality of mounting holes;
- a plurality of poles each mounted in a corresponding one of the mounting holes in such a manner that each pole is movable in its respective mounting hole, each end of the pole forming a screw thread; and
- a plurality of slidable members each slidably mounted on a corresponding one of the poles, each of the slidable members including a holding portion configured for holding one of the optical members; and
- an adjusting assembly mounted on each of the poles and configured for adjusting a position of slidable members in a manner so as to enable the holding portions of the slidable members suitable for holding the one of the optical members, the adjusting assembly including a plurality of nuts and a resilient member, and one end of each pole being mounted on the positioning assembly by the nut engaging with the screw thread and the resilient member being positioned between the slidable member and the positioning assembly.

12. The washing mechanism as claimed in claim 11, wherein the resilient member is a compression spring.

13. The washing mechanism as claimed in claim 11, wherein two ends of the pole are exposed out of the mounting hole of the positioning member.

14. The washing mechanism as claimed in claim 13, wherein the mounting hole is configured to enable the poles to move in a transverse direction and/or in a lengthways direction.

15. The washing mechanism as claimed in claim 11, wherein each slidable member includes a carrying part and a sleeve, the sleeve defining a slot therein configured for receiving the carrying part, and the carrying part defining a plurality of grooves.

16. The washing mechanism as claimed in claim 15, wherein the carrying part is a substantially rectangular board defining a plurality of V-shaped grooves.

* * * * *